US005334079A

United States Patent [19]

Gentile et al.

[11] Patent Number: 5,334,079

[45] Date of Patent: Aug. 2, 1994

[54] TOY HAVING FLEXIBLE SHELL FOR LAUNCHING PROJECTILES

[75] Inventors: John J. Gentile, Montclair, N.J.; Anthony Gentile, New York, N.Y.

[73] Assignee: Abrams/Gentile Entertainment Inc., New York, N.Y.

[21] Appl. No.: 36,133

[22] Filed: Mar. 23, 1993

[51] Int. Cl.[5] ..... A63H 13/10; A63H 33/00; A63B 65/00

[52] U.S. Cl. ..... 446/486; 446/308; 446/4; 273/428

[58] Field of Search ..... 446/486, 430, 429, 311, 446/309, 308, 169, 168, 6, 4; 273/584, 424, 428, DIG. 25; 124/1, 10, 16, 79; 434/300, 302

[56] References Cited

U.S. PATENT DOCUMENTS

| | | | |
|---|---|---|---|
| 1,677,122 | 7/1928 | Johnson . | |
| 2,153,957 | 4/1939 | Davis . | |
| 2,562,685 | 7/1951 | Adams | 297/15 |
| 3,068,851 | 12/1962 | Geer, Jr. | 124/16 |
| 3,627,319 | 12/1971 | Van Skyhawk | 124/16 |
| 3,744,472 | 7/1973 | O'Ryan | 124/1 |
| 4,152,863 | 5/1979 | Kubiatowicz | 46/1 |
| 4,848,773 | 7/1989 | Lovik | 273/458 |
| 5,046,984 | 9/1991 | Cane | 446/168 |
| 5,205,773 | 4/1993 | Koepcke et al. | 446/429 |
| 5,213,538 | 5/1993 | Willett | 446/486 |

*Primary Examiner*—Robert A. Hafer
*Assistant Examiner*—Michael O'Neill
*Attorney, Agent, or Firm*—Kenyon & Kenyon

[57] ABSTRACT

A toy for launching projectiles. The toy includes a flexible shell generally having a convex outer surface and a concave inner surface. The convex outer surface has a first protrusion and a plurality of claws. The concave inner surface has a second protrusion. A first projectile is mountable on the first protrusion. A second projectile is mountable on the second protrusion. When the first projectile is mounted on the first protrusion and the shell is inverted such that the convex outer surface becomes a concave surface, the plurality of claws grip the first projectile. Thereafter, when pressure is applied to the shell, the shell returns to its original non-inverted shape and the first projectile is discharged into the air. Moreover, when the second projectile is mounted on the second protrusion and the shell is inverted such that the convex outer surface becomes a concave surface and is thereafter dropped on a hard surface, the shell returns to its original non-inverted shape and the second projectile is discharged into the air.

42 Claims, 5 Drawing Sheets

TOY HAVING FLEXIBLE SHELL FOR LAUNCHING PROJECTILES

Copyright Notice

A portion of the disclosure of this patent document contains material which is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF INVENTION

The present invention is directed to a toy for propelling a projectile, and more particularly, a toy for launching a projectile both by hand and through impact with a hard surface.

BACKGROUND OF THE INVENTION

Children enjoy toys that launch objects into the air. Also, children like to play in groups with toys that can be used to launch objects at each other. Such toys should be designed so that the children are not hurt by the projectile as may happen when launching an object with too much force.

Prior toys that are launched from the ground commonly use a spring. For these toys, the spring is compressed and will release after a certain period of time, launching the toy into the air. Other toys that jump from the ground are shaped like disks. One such toy comprises two disks that are made from metals having different coefficients of expansion. The toy will jump upwards when placed on a surface of a different temperature. Other toys, made from rubber, will jump from the ground when placed on the ground in a deformed shape, the toy jumping when the rubber returns to its original shape. The above described toys are placed on the ground and jump upwards when left for a certain period. The time it takes for the toy to jump upwards is uncertain. Moreover, these toys are designed to remain as a whole. The part of the toy that makes the toy jump is not separable from the part of the toy that jumps into the air.

Other toys will bounce when dropped to the ground. For example, a rubber ball will bounce when dropped on a hard surface. These toys bounce and are usually made from a single part. The height the toy reaches from the ground is less than the height from which the toy was dropped. No projectiles can be launched from such bouncing toys. A projectile is not fired from these toys when the toy comes in contact with the ground.

Toys used to launch a projectile from the hand mostly use springs or catapults. The object to be launched is placed near the spring or catapult and is shot forwards when a release mechanism is activated. When children are moving about and playing with such toys, the object to be launched must remain in the same position, near the spring or catapult. Such toys require expensive launching mechanisms and complex projectile-holding parts. Moreover, the toys held in the hand that are used to launch an object are not designed to launch objects when dropped to the ground.

As children enjoy playing with toys that have more than one function, it is desirable for a launching toy to be able to both fire objects from the hand and to project or fire objects when coming in contact with a hard surface, such as when coming in contact with the ground. When operated from a hand-held position, it is desirable that the object to be launched remains in position until it is fired. When projecting an object from the ground, it is captivating if the object when fired move at a fast speed and to a height greater than that from which the launching toy was dropped.

SUMMARY OF THE INVENTION

The present invention is a toy that can both launch an object when held in the hand and also launch an object when dropped on a hard surface, such as the ground. In the representative embodiment, the launching device, called a flexible shell, is a simple unitary rubber shell, with protrusions and claws to hold the objects to be launched in position prior to being launched.

The toy of the present invention has two modes of operation. The toy is operated in "Fire mode" when it is hand-held and used to launch an object from the flexible shell. In this mode, the flexible shell remains in the user's hands. When the toy is operated in "Drop mode", it is dropped or thrown on a hard surface, such as the ground and an object is launched from the flexible shell.

In this mode, the flexible shell (and the attached object) is dropped by the user. In the representative embodiment, the object launched when the flexible shell is hand-held (i.e., in Fire mode) is a soft projectile, such as a rubber or plastic spaceship or missile. The object launched from the ground when the flexible shell is dropped (i.e., in Drop mode) is called a drop projectile. The drop projectile is, in the representative embodiment, a toy action figure. However, the object launched when the flexible shell is hand-held and the object launched when the flex Shell is dropped can be the same object.

Accordingly, the toy of the representative embodiment of the present invention comprises three parts, namely the flexible shell, the soft projectile, which is used in Fire mode, and the drop projectile, which is used in Drop mode.

In the representative embodiment, the flexible shell is molded from flexible rubber that can be bent out of shape but will generally stay in the manipulated position until an external force is applied thereto. The flexible shell is, in its regular position, half-dome or hemispherical in shape, with an empty inner portion. It is single curved piece of rubber, similar in shape to a squash ball or tennis ball cut in half.

On the outer (or convex) side of the flexible shell, when it is in its regular position, are four claws (or nibs) and one outer protrusion. On the inner (or convex) side of the flexible shell, when it is in its regular position, is a single inner protrusion. The four claws and the outer protrusion point in the same direction. The outer protrusion is located at the center of the outer side of the flexible shell at right angles to the surface of the flexible shell. In the representative embodiment, the four claws are located around the outer protrusion, approximately half way between the outer protrusion and the rim of the flexible shell.

The four claws and the outer protrusion are used in Fire mode. The soft projectile has a hole in it and can be mounted on the outer protrusion by the user. The flexible shell is then turned inside-out (i.e., inverted in shape) by the user. In doing this, the four claws turn inward towards the outer protrusion and grip the soft projectile. The flexible shell will remain in this position until an external force is applied to it. The user, with the soft projectile facing away, can cause the flexible shell to return to its original shape, for example, by gently pushing the inner protrusion (which will be pointing towards the user). The flexible shell will, in returning to its original position, cause the claws to move away from and thereby release the soft projectile which will be projected or launched away from the user due to the kinetic energy released by the flexible shell when it returns to its regular shape. The user will retain the flexible shell so that another soft projectile can be launched. In the representative embodiment, the soft projectile can, in Fire mode, be shot up to 30 feet.

The four claws not only act as retention means to hold the soft projectile in place. The four claws also guide the soft projectile so that the soft projectile does not fly off haphazardly but, instead, can be directed as desired by aiming the flexible shell.

It is noted that the number of claws on the flexible shell can be varied to accommodate different sized and shaped projectiles. In the representative embodiment, four claws are used, but the toy of the present invention will function equally well with, for example, three or five claws. Further, the projectile launched in Fire mode is, in the representative embodiment, a soft projectile. In Fire mode, the projectile launched can be another object, including hard and soft plastic, rubber, metal or wooden objects, such as, for example, a toy action figure, a toy action figure accessory, an airplane, a bomb or a spaceship.

As stated above, on the inner (or convex) side of the flexible shell when it is in its regular position is a single inner protrusion. The inner protrusion is used in Drop mode. The drop projectile has a hole in it and can be mounted on the inner protrusion by the user, inside the flexible shell. The flexible shell is then turned inside-out by the user. In doing this, the drop projectile in effect becomes mounted on the top of the now outer side of the flexible shell. The user can then drop the flexible shell and the attached drop projectile onto a hard surface, such as the floor. The flexible shell on impacting with the hard surface will return to its original shape. This will cause the drop projectile to be become detached from the flexible shell and the drop projectile will then be launched or fired from the flexible shell high into the air. The drop projectile will travel many times higher than the height position from which the flexible shell was dropped. The flexible shell will also project into the air, but not to such a great height.

The drop projectile launched in Drop mode is, in the representative embodiment, a toy action figure. In Drop mode, other objects can be launched, including various hard and soft rubber, plastic, metal or wooden objects, such as, for example, toy animals, airplanes, bombs and spaceships.

In a further embodiment, on some Drop mode launching occasions, the drop projectile can be replaced by the soft projectile that is usually used in Fire mode. In the further embodiment, the soft projectile is much lighter than the drop projectile. When the soft projectile is used in Drop mode, it will not detach and both the flexible shell and the soft projectile (now inside the flexible shell) will leap into the air. The flexible shell will change back to its original shape, encasing the soft projectile.

As a further option, the flexible shell can be accompanied by a toy action figure. The toy action figure is of a height greater than diameter of the flexible shell. The toy action figure has protrusions or extensions in its front or rear used to mount the flexible shell. For example, in the representative embodiment, three protrusions are located on the rear of the toy action figure. One protrusion is located on the toy action figure's head, and a protrusion is located on each of the toy action figure's legs. The protrusions are separated by a distance such that the flexible shell must be bent slightly to fit between these protrusions, i.e., the distance between the protrusion on the head and each protrusion on the legs is slightly less than the diameter of the flexible shell. The flexible shell is bent and placed between the protrusions on the toy action figure. Tension holds the flexible shell in position, with the edge of the flexible shell pressing against each of the three protrusions. To increase the fun when playing with the toy of the present invention, the flexible shell can be designed to resemble a shield or some other real-world device.

In an alternative embodiment, the flexible shell is aerodynamically designed so that it can be thrown in the air like a flying saucer. The flexible shell is inverted and its is thrown by a user into the air. On hitting a hard surface, the flexible shell will return to its original shape, and thus pop into the air. The more level the flexible shell hits a hard surface, the higher the pop into the air.

DETAILED DESCRIPTION

Figure 1A:
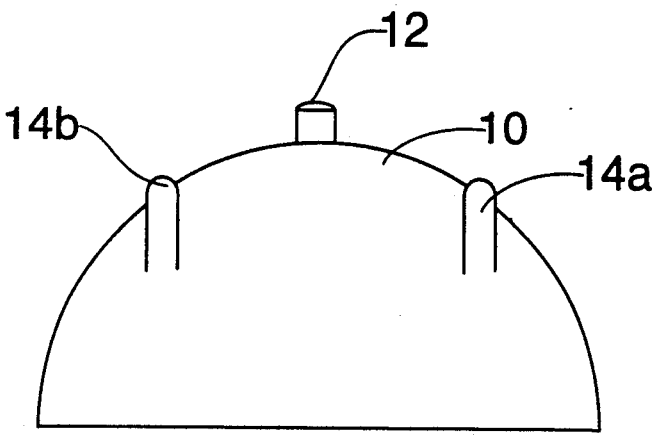
FIG. 1*a* is a side view of the flexible shell of the present invention in its regular shape.

In the drawings, like parts are identified by the same reference character.

Referring now to the drawings, and initially FIG. 1*a*, there is illustrated in side view the launching device of the present invention, called a flexible shell 10. In FIG. 1*a*, the flexible shell 10 is shown in its regular or non-inverted) shape. Preferably, the flexible shell 10 is made of rubber.

An outer protrusion 12 is located at the center of the outer side of the flexible shell 10 at right angles to the surface of the flexible shell 10. In the representative embodiment, claws 14*a* and 14*b* are located around the outer protrusion 12, approximately half way between the outer protrusion 12 and the rim of the flexible shell 10. (Because FIG. 1*a* is a side view, only two of the four claws 14*a* and 14*b* can be seen.)

The four claws 14*a* and 14*b* and the outer protrusion 12 are used in Fire mode. In the Fire mode, a projectile (not shown) is mounted on the outer protrusion 12 and is gripped by the four claws 14*a* and 14*b* when the flexible shell 10 is turned inside-out (i.e., when the flexible shell 10 is inverted).

Figure 1B:
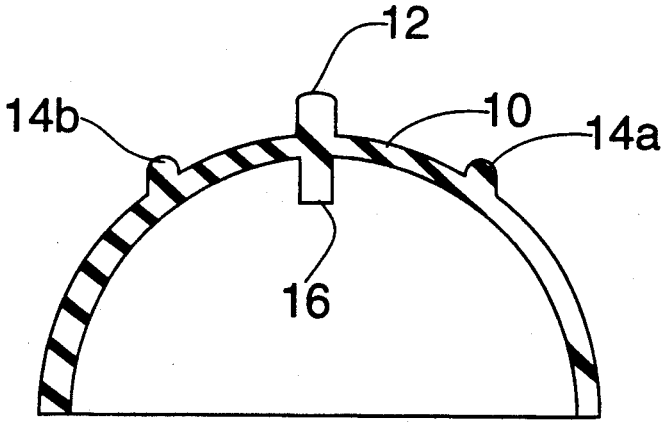
FIG. 1*b* is a side profile view of the flexible shell of FIG. 1*a*.

Referring now to FIG. 1*b*, there is illustrated in side profile view the flexible shell 10 of FIG. 1*a*.

An inner protrusion 16 is located inside the flexible shell 10, facing the opposite direction to that of the outer protrusion 12. The inner protrusion 16 is used to mount a projectile (not shown) when being used in Drop mode.

Figure 2:
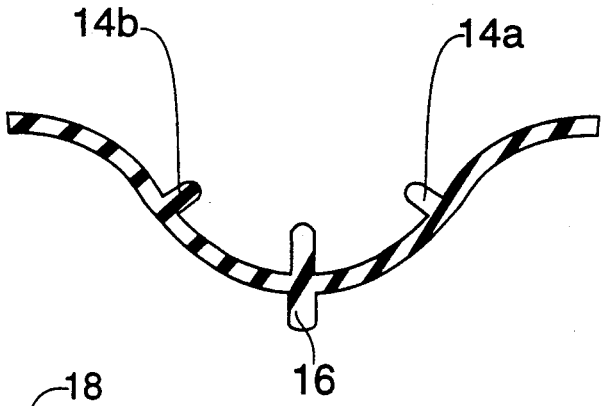
FIG. 2 is a side profile view of the flexible shell when inverted.

Referring now to FIG. 2, there is illustrated in side profile view the flexible shell 10 component of FIG. 1*a* when turned inside-out (or inverted). The flexible shell 10 is turned inside-out when a user wishes to fire a projectile (not shown) in the Drop mode.

Figure 3A:
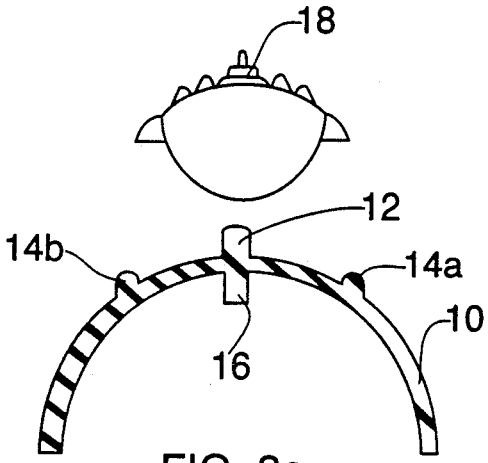
FIGS. 3*a* to 3*c* illustrate the Fire mode procedure of the present invention.
Figure 3B:
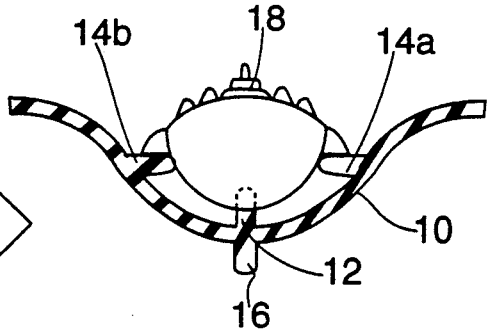
Figure 3C:
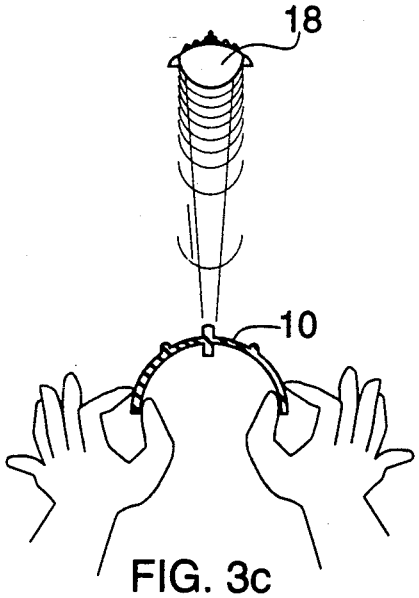

Referring now to FIGS. 3*a*, 3*b* and 3*c*, there is illustrated, in side profile view, the Fire mode procedure for the flexible shell 10 of FIG. 1*a*. In FIG. 3*a*, the flexible shell 10 is in its regular shape. A projectile 18, which has a hole in its base, is mounted on the outer protrusion 12. In FIG. 3*b*, the flexible shell 10 is shown after the user has turned it inside-out in preparation for firing. The claws 14*a* and 14*b* clasp the projectile 18. In the representative embodiment, the projectile 18 is made from soft plastic to enable the claws 14*a* and 14*b* to easily grasp onto the projectile 18.

FIG. 3*c* shows the launching process in Fire mode. To launch the projectile 18, the user holds the flexible shell 10 with the projectile facing away, and pushes gently on the inner protrusion 16 with his or her thumbs. This will cause the flexible shell to return to its original shape (i.e. at FIG. 1*a* or FIG. 3*a*) and will launch the projectile 18 from the flexible shell 10. As shown in FIG. 3*c*, the projectile will travel in the direction towards the top of the figure.

Figure 4A:
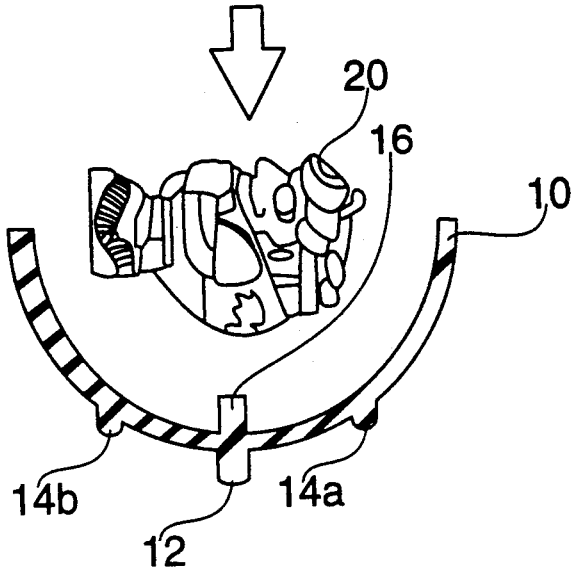
FIGS. 4*a* and 4*b* illustrate the Drop mode procedure of the present invention.
Figure 4B:
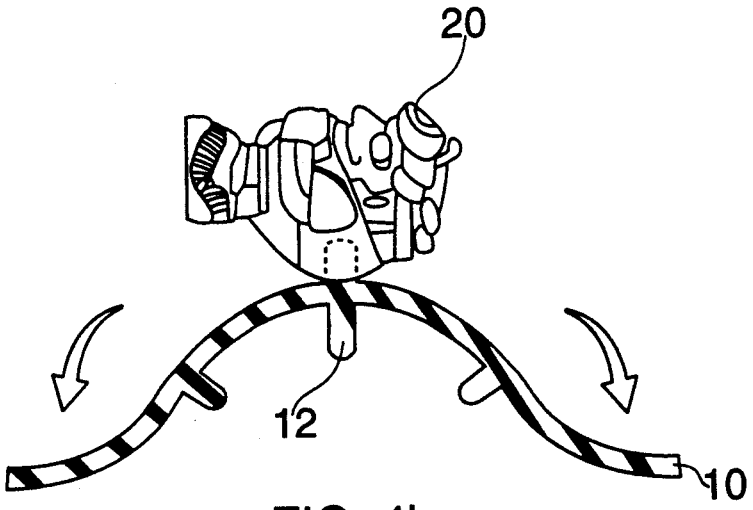

Referring now to FIGS. 4*a* and 4*b*, there is illustrated, in side profile view, the Drop mode procedure for the flexible shell 10 of FIG. 1*a*. In FIG. 4*a*, the flexible shell 10 is in its regular shape. A projectile 20, which has a hole in it, is mounted on the inner protrusion 16. In FIG. 3*b*, the flexible shell 10 is shown after the user has turned it inside-out in preparation for firing. In the representative embodiment, the projectile 20 is a toy action figure made from a heavy plastic to enable it to fly high into the air. The hole is located in the back of the toy action figure.

To fire the projectile 20 in Drop mode, the flexible shell 10 with the projectile 20 attached (as shown in FIG. 4*b*) is dropped onto a hard object, such as the ground. The flexible shell will return to its original shape (as shown in FIG. 1*a*) and the projectile 20 will detach from the flexible shell 10 and shoot high into the air. Alternatively, the projectile 20 will not detach from the flexible shell 10, and the flexible shell with the projectile 20 attached will leap into the air.

Figure 5A:
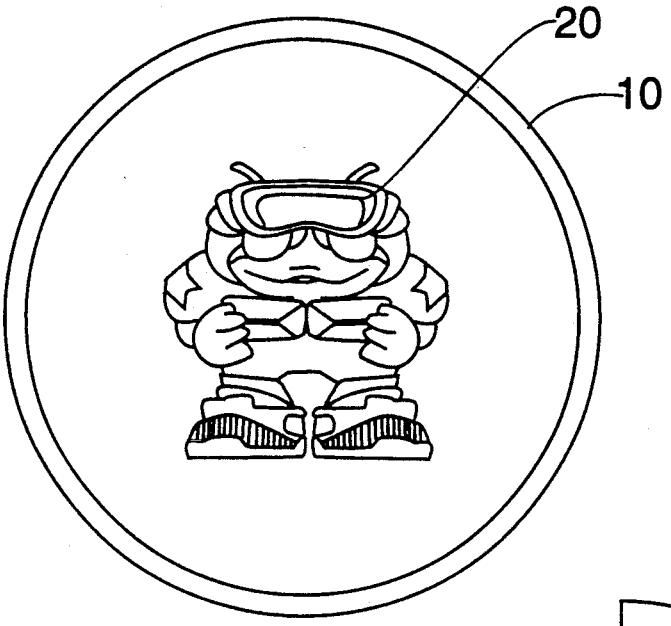
FIGS. 5*a* to 5*c* illustrate the flexible shell of FIG. 1*a* and the projectile used in Drop mode.
Figure 5B:
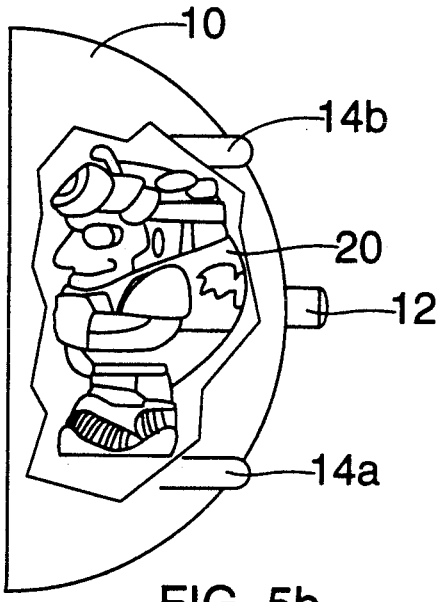
Figure 5C:
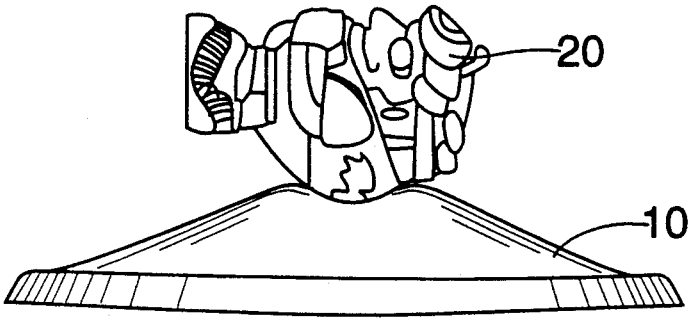

Referring now to FIGS. 5*a*, 5*b* and 5*c*, there is illustrated in further detail the flexible shell 10 and the projectile 20 when used in Drop mode. FIG. 5*a* is a front view of the flexible shell 10, looking into the interior of the flexible shell 10, with the projectile 20 attached, prior to inversion of the flexible shell. (FIG. 5*a* is the view seen from the direction of the arrow in FIG. 4*a*.) FIG. 5*b* is a side view of the flexible shell 10 with the projectile 20 loaded, prior to the inversion of the flexible shell. For clarity, the flexible shell 10 as shown in FIG. 5*b* has transparent walls. FIG. 5*c* shows a side view of the inverted flexible shell 10 (as in FIG. 2) with the projectile 20 attached (as in FIG. 4*b*). When dropped, the flexible shell 10 will return to its regular shape and cause the projectile 20 to be fired into the air. Alternatively, if projectile 20 is designed to fit tightly onto the inner protrusion 16 (or another suitably designed projectile, such as projectile 18, is used instead of projectile 20), the flexible shell, after hitting the hard surface, will return to its original shape with the projectile 20 still attached thereto (see FIG. 5*b*) and spring into the air.

Figure 6A:
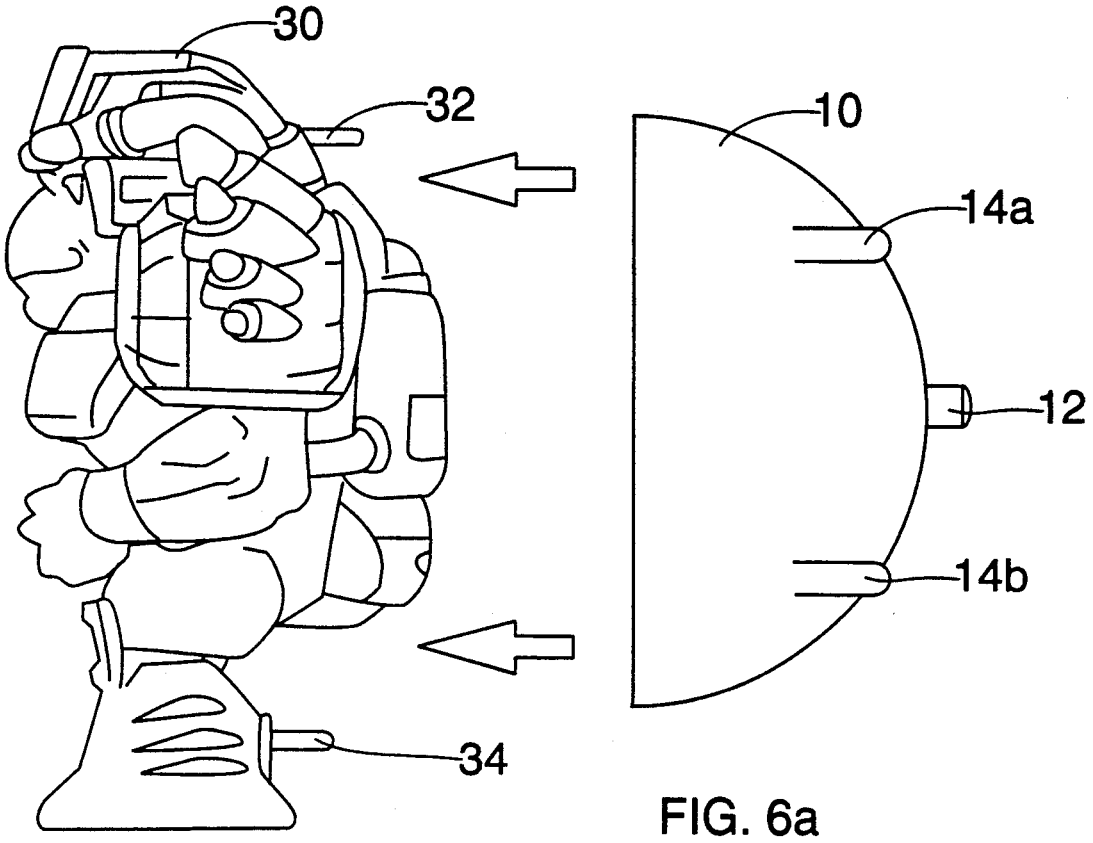
FIGS. 6*a* and 6*b* show a toy action figure used to mount the flexible shell of FIG. 1*a*.
Figure 6B:
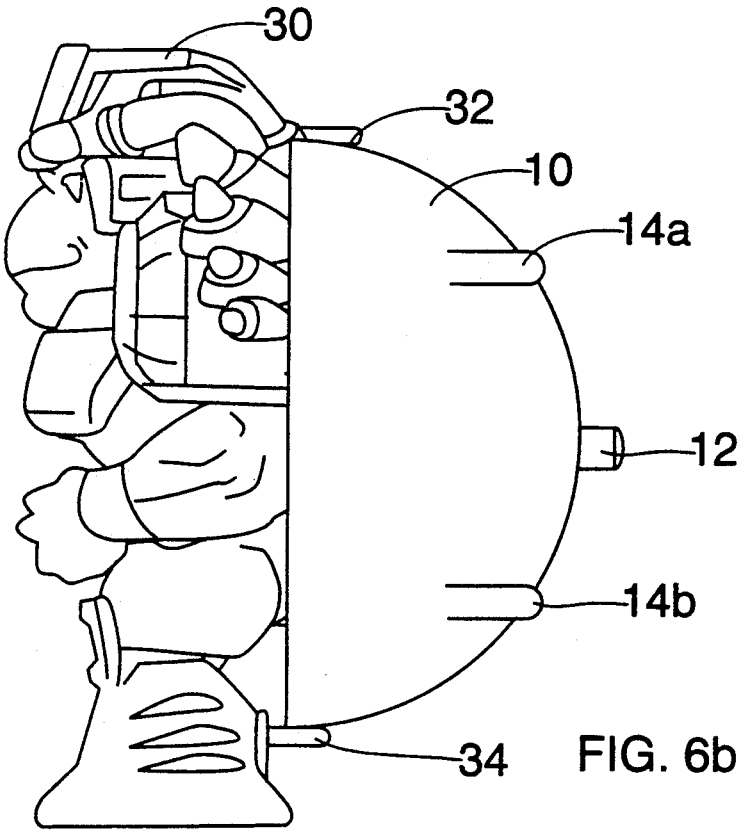

Referring now to FIGS. 6*a* and 6*b*, there is illustrated a side view of the flexible shell 10 of FIG. 1*a* and a toy action FIG. 30. The flexible shell 10 can be mounted on the toy action FIG. 30. The toy action FIG. 30 has three protrusions 32 and 34 that are located on the rear of the toy action FIG. 30. One protrusion 32 is located on the toy action figure's head, and a protrusion 34 is located on each of the toy action figure's legs. The protrusions 32 and 34 are separated by a distance such that the flexible shell 10 must be bent slightly to fit between these protrusions 32 and 34. As shown in FIG. 6*b*, the flexible shell is bent and placed between the protrusions 32 and 34 on the toy action FIG. 30. Tension holds the flexible shell 10 in position, with the edge of the flexible shell 10 pressing against each of the three protrusions 32 and 34.

What is claimed is:

1. A toy for launching projectiles, the toy comprising:

a flexible shell with a thin wall generally having a convex outer surface and a concave inner surface, the convex outer surface including a first protrusion and a plurality of claws, the concave inner surface including a second protrusion;

a first projectile releasably mounted on the first protrusion; and a second projectile releasably mounted on the second protrusion;

wherein, when the first projectile is mounted on the first protrusion and the shell is inverted such that the convex outer surface becomes a concave surface, the plurality of claws grips the first projectile and thereafter, when pressure is applied to the shell, the shell returns to its original non-inverted shape and the first projectile is discharged from the shell into the air and wherein, when the second projectile is mounted on the second protrusion and the shell is inverted such that the convex outer surface becomes a concave surface and is thereafter dropped on a hard surface, the shell returns to its original non-inverted shape and the second projectile is discharged from the shell into the air.

2. The toy of claim 1 wherein the shell is made of rubber.

3. The toy of claim 1 wherein the first projectile is made of plastic, wherein the first projectile is softer than the second projectile and wherein the first projectile is lighter than the second projectile.

4. The toy of claim 1 wherein the first projectile is a spaceship.

5. The toy of claim 1 wherein the first projectile is a toy action figure accessory.

6. The toy of claim 1 wherein the second projectile is a toy action figure.

7. The toy of claim 1 wherein the plurality of claws direct the angle of discharge of the first projectile.

8. The toy of claim 1 wherein there are four claws.

9. The toy of claim 1 wherein the second projectile is discharged into the air to reach a height greater than that from which the shell was dropped.

10. The toy of claim 3 wherein, when the first projectile is mounted on the second protrusion and the shell is inverted such that the convex outer surface becomes a concave surface and is thereafter dropped on a hard surface, the shell returns to its original non-inverted shape and the first projectile remains attached to the shell and both the shell and the first projectile leap into the air attached.

11. The toy of claim 1 further comprising a toy action figure, the toy action figure including a plurality of extensions such that the shell can be coupled to the toy action figure.

12. The toy of claim 11 wherein the plurality of extensions project from the rear of the toy action figure.

13. The toy of claim 11 wherein at least two of the plurality of extensions are separated by a distance less that the diameter of the shell.

14. The toy of claim 11 wherein a first extension is located on the rear of the head of the toy action figure and second and third extension are located on the rear of each leg of the toy action figure.

15. The toy of claim 1 wherein the shell is aerodynamically shaped.

16. The toy of claim 1 wherein the shell is aerodynamically shaped when inverted, and wherein, after thrown into the air, upon hitting the ground, the shell will return to its original non-inverted shape and spring back into the air.

17. A toy for launching projectiles, the toy comprising:

a flexible launching device having a convex outer surface and a concave inner surface, the convex outer surface including a protrusion and a plurality of nibs; and a projectile releasably mounted on the protrusion wherein, when the projectile is mounted on the protrusion and the launching device is inverted such that the convex outer surface becomes a concave surface, the plurality of nibs grip the projectile and thereafter, when pressure is applied to the launching device, the launching device returns to its original non-inverted shape and the projectile is discharged from the launching device.

18. The toy of claim 17 wherein the launching device is made of rubber.

19. The toy of claim 17 wherein the projectile is made of plastic.

20. The toy of claim 17 wherein the projectile is a toy action figure accessory.

21. The toy of claim 17 wherein the plurality of nibs direct the angle of discharge of the projectile.

22. The toy of claim 17 wherein there are between two and six nibs.

23. The toy of claim 17 further comprising a toy action figure, the toy action figure including a plurality of extensions such that the launching device can be coupled to the toy action figure.

24. The toy of claim 17 wherein the launching device is aerodynamically shaped when inverted, and wherein, after thrown into the air, upon hitting the ground, the launching device will return to its original non-inverted shape and spring back into the air.

25. A toy for launching projectiles, the toy comprising:

a flexible shell with a thin wall generally having a convex outer surface and a concave inner surface, the concave inner surface including a protrusion;

a projectile mountable on the protrusion, wherein, when the projectile is mounted on the protrusion and the shell is inverted such that the convex outer surface becomes a concave surface and is thereafter dropped on a hard surface, the shell returns to its original non-inverted shape and the projectile separates from the shell and is discharged into the air; and a toy action figure of a length greater than the diameter of the shell, the toy action figure including a plurality of extensions such that the shell can be coupled to the outside of the toy action figure.

26. The toy of claim 25 wherein the shell is made of rubber.

27. The toy of claim 25 wherein the projectile is discharged into the air to reach a height greater than that from which the shell was dropped.

28. The toy of claim 25 wherein, when the projectile is mounted on the protrusion and the shell is inverted such that the convex outer surface becomes a concave surface and is thereafter dropped on a hard surface, the shell returns to its original non-inverted shape and the projectile remains attached to the shell and both the shell and the projectile leap into the air attached.

29. The toy of claim 25 wherein the plurality of extensions project from the rear of the toy action figure.

30. The toy of claim 25 wherein at least two of the plurality of extensions are separated by a distance less than the diameter of the shell.

31. The toy of claim 25 wherein the shell is aerodynamically shaped.

32. A toy for launching projectiles, the toy comprising:

a flexible shell generally having a convex outer surface and a concave inner surface, the concave inner surface including a protrusion; and a projectile releasably mounted on the protrusion, wherein, when the projectile is mounted on the protrusion and the shell is inverted such that the convex outer surface becomes a concave surface and is thereafter dropped on a hard surface, the shell returns to its original non-inverted shape and the projectile separates from the shell and is discharged into the air.

33. The toy of claim 32 wherein the shell is made of rubber.

34. The toy of claim 32 wherein the projectile is a toy action figure.

35. The toy of claim 32 wherein the projectile is discharged into the air to reach a height greater than that from which the shell was dropped.

36. The toy of claim 32 wherein projectile is made of plastic.

37. The toy of claim 32 further comprising a toy action figure, the toy action figure including a plurality of extensions such that the shell can be mounted on the toy action figure.

38. The toy of claim 37 wherein the plurality of extensions project from the rear of the toy action figure.

39. The toy of claim 32 wherein the shell is aerodynamically shaped.

40. A toy for launching projectiles, the toy comprising:

a flexible shell with a thin wall generally having a convex outer surface and a concave inner surface, the convex outer surface including a first protrusion and a plurality of claws, the concave inner surface including a second protrusion; and a first projectile releasably mounted on either the first protrusion or second protrusion, the first projectile when mounted on the second protrusion fitting tightly on the second protrusion due to the relative size of the second protrusion to the first projectile;

wherein, when the first projectile is mounted on the first protrusion and the shell is inverted such that the convex outer surface becomes a concave surface, the plurality of claws grip the first projectile and thereafter, when the pressure is applied to the shell, the shell returns to its original non-inverted shape and the first projectile is discharged into the air and wherein, when the first projectile is mounted on the second protrusion and the shell is inverted such that the convex outer surface becomes a concave surface and is thereafter dropped on a hard surface, the shell returns to its original non-inverted shape and the first projectile remains attached to the shell and both the shell and the first projectile leap into the air attached.

41. The toy of claim 40 further comprising a second projectile mountable on the second protrusion, the second projectile being harder than the first projectile, wherein, when the second projectile is mounted on the second protrusion and the shell is inverted such that the convex outer surface becomes a concave surface and is thereafter dropped on a hard surface, the shell returns to its original non-inverted shape and the second projectile is discharged into the air.

42. A toy for launching projectiles, the toy comprising:

a flexible launching device having a convex outer surface and a concave inner surface, the convex outer surface including a protrusion and a plurality of nibs;

a projectile mountable on the protrusion wherein, when the projectile is mounted on the protrusion and the launching device is inverted such that the convex outer surface becomes a concave surface, the plurality of nibs grip the projectile and thereafter, when pressure is applied to the launching device, the launching device returns to its original non-inverted shape and the projectile is discharged; and a toy action figure including a plurality of extensions such that the launching device can be coupled to the toy action figure, the plurality of extensions including a first extension located on the rear of the head of the toy action figure and second and third extension located on the rear of each leg of the toy action figure.

* * * * *